US005107610A

United States Patent [19]

Fusco

[11] Patent Number: 5,107,610

[45] Date of Patent: Apr. 28, 1992

[54] QUICK-COUPLING CONNECTOR FOR BACKHOES AND THE LIKE

[76] Inventor: Nicholas Fusco, 16 Lee Rd., Prospect, Conn. 06712

[21] Appl. No.: 644,297

[22] Filed: Jan. 22, 1991

[51] Int. Cl.[5] ..... E02F 5/02

[52] U.S. Cl. ..... 37/103; 37/118 R; 37/DIG. 12; 414/723

[58] Field of Search ..... 37/117.5, 103, 118 A, 37/118 R, 141 R, DIG. 12, 231, 235, 236; 414/723, 724, 722

[56] References Cited

U.S. PATENT DOCUMENTS

| | | | |
|---|---|---|---|
| 3,876,091 | 4/1975 | MacDonald | 214/145 |
| 4,085,856 | 4/1978 | Westendorf | 214/145 |
| 4,119,225 | 10/1978 | Macht et al. | 214/145 |
| 4,187,050 | 2/1980 | Barbee | 37/103 X |
| 4,203,238 | 5/1980 | Bangert et al. | 37/118 R |
| 4,208,162 | 6/1980 | Neitzel | 414/686 |
| 4,295,287 | 10/1981 | Natzke et al. | 37/118 R |
| 4,345,872 | 8/1982 | Arnold | 414/705 |
| 4,417,844 | 11/1983 | de Pingon | 414/723 |
| 4,597,205 | 7/1986 | Guest | 37/117.5 X |
| 4,663,866 | 5/1987 | Karlsson et al. | 37/117.5 |
| 4,813,163 | 3/1989 | Livingston et al. | 37/103 |
| 4,858,345 | 8/1989 | Abe et al. | 37/118 R |
| 4,955,779 | 9/1990 | Knackstedt | 414/723 |
| 5,000,269 | 3/1991 | Aoki et al. | 37/231 X |

*Primary Examiner*—Dennis L. Taylor
*Assistant Examiner*—J. Russell McBee
*Attorney, Agent, or Firm*—John H. Crozier

[57] ABSTRACT

In a preferred embodiment, a connector to attach construction implements to construction machinery which includes joinable fixed and removable portions. The fixed portion is attached to the implement and includes a plurality of tapered openings formed in support walls. The movable portion includes two fixed engagement cones which are engagable with two openings in one of the walls. When the two fixed cones are so engaged, a movable engagement cone is inserted in an opening in the other of the walls. Attachment is rapid and the engagement cones provide for automatic compensation for wear and misfit.

4 Claims, 4 Drawing Sheets

QUICK-COUPLING CONNECTOR FOR BACKHOES AND THE LIKE

BACKGROUND OF THE INVENTION

1. Field of the Invention

The present invention relates generally to means for attaching shovels and other working implements to backhoes and similar equipment and, more particularly, to a novel attachment means that provides for rapid and secure attachment of such implements.

2. Background Art

Backhoes, excavators, front end loaders, and similar equipment must be equipped with means for attaching working implements such as shovels, concrete breakers, buckets, and blades, to a movable boom. Conventionally, such attachment is by means of bolts, pins, and/or shafts which require a fairly long time for a mechanic to install. Frequently, because of worn, damaged, or otherwise misfitting parts, the mechanic must take the additional time to provide shims between mating parts to accommodate the misfit.

Some attempts have been made to provide more rapid means of attachment, but these typically have many parts, generally are relatively expensive, and some do not adequately secure the mating parts. Many do not adequately compensate for wear.

Accordingly, it is a principal object of the present invention to provide a mechanism for rapid attachment of working implements to backhoes or the like.

It is an additional object of the invention to provide such a mechanism that is simple and economically constructed.

It is a further object of the invention to provide such a mechanism that can automatically accommodate a relatively high degree of wear of, or otherwise misfit between, the mating parts.

It is another object of the invention to provide such a mechanism that can be easily retrofitted to existing equipment.

Other objects of the present invention, as well as particular features and advantages thereof, will be elucidated in, or be apparent from, the following description and the accompanying drawing figures.

SUMMARY OF THE INVENTION

The present invention achieves the above objects, among others, by providing, in a preferred embodiment, a connector to attach construction implements to construction machinery which includes joinable fixed and removable portions. The fixed portion is attached to the implement and includes a plurality of tapered openings formed in support walls. The movable portion includes two fixed engagement cones which are engagable with two openings in one of the walls. When the two fixed cones are so engaged, a movable engagement cone is inserted in an opening in the other of the walls. Attachment is rapid and the engagement cones provide for automatic compensation for wear and misfit.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, in which.

DETAILED DESCRIPTION OF THE PREFERRED EMBODIMENT

Figure 1:
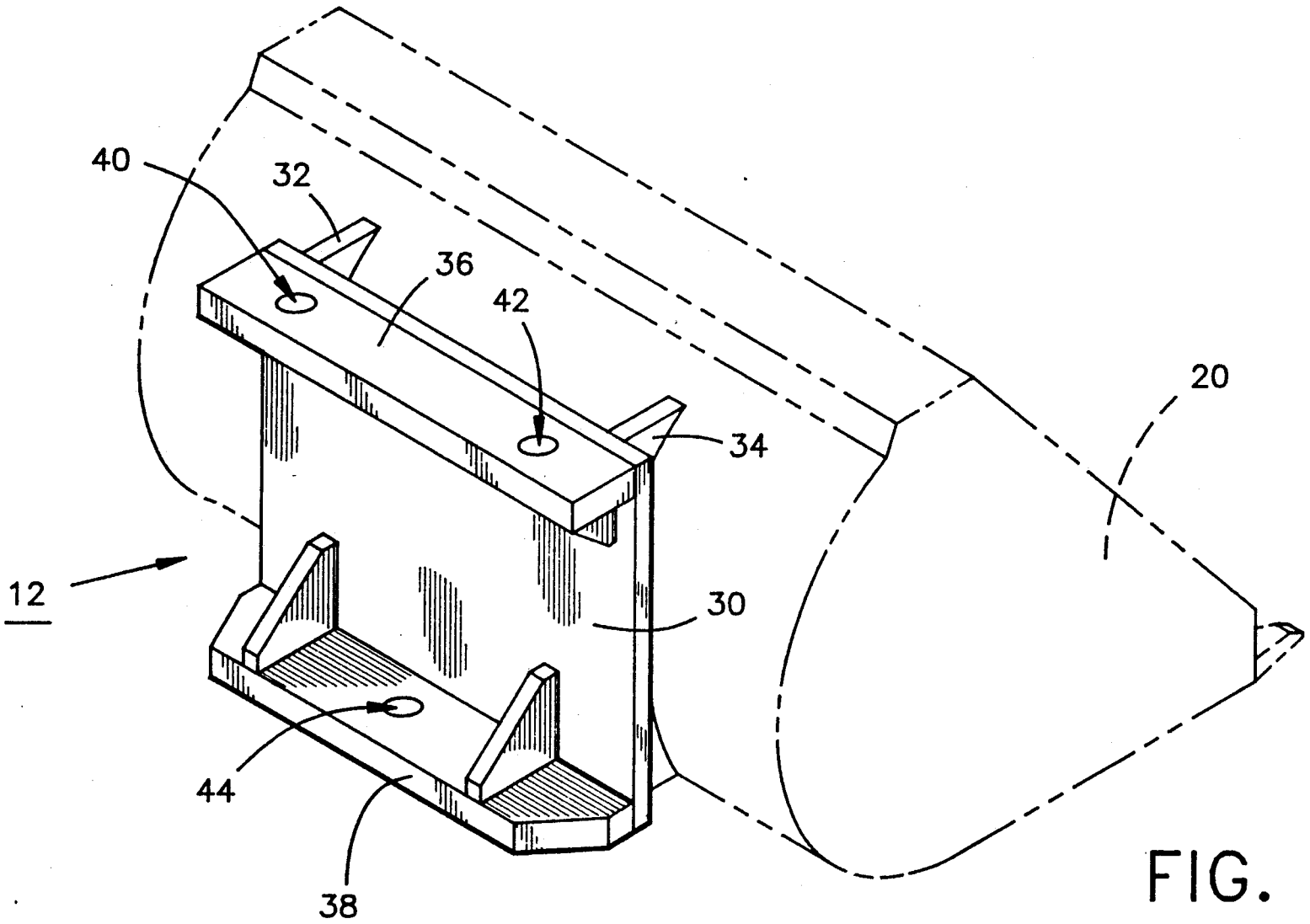
FIG. 1 is a perspective view of a fixed portion of a connector according to the present invention, attached to a shovel
Figure 2:
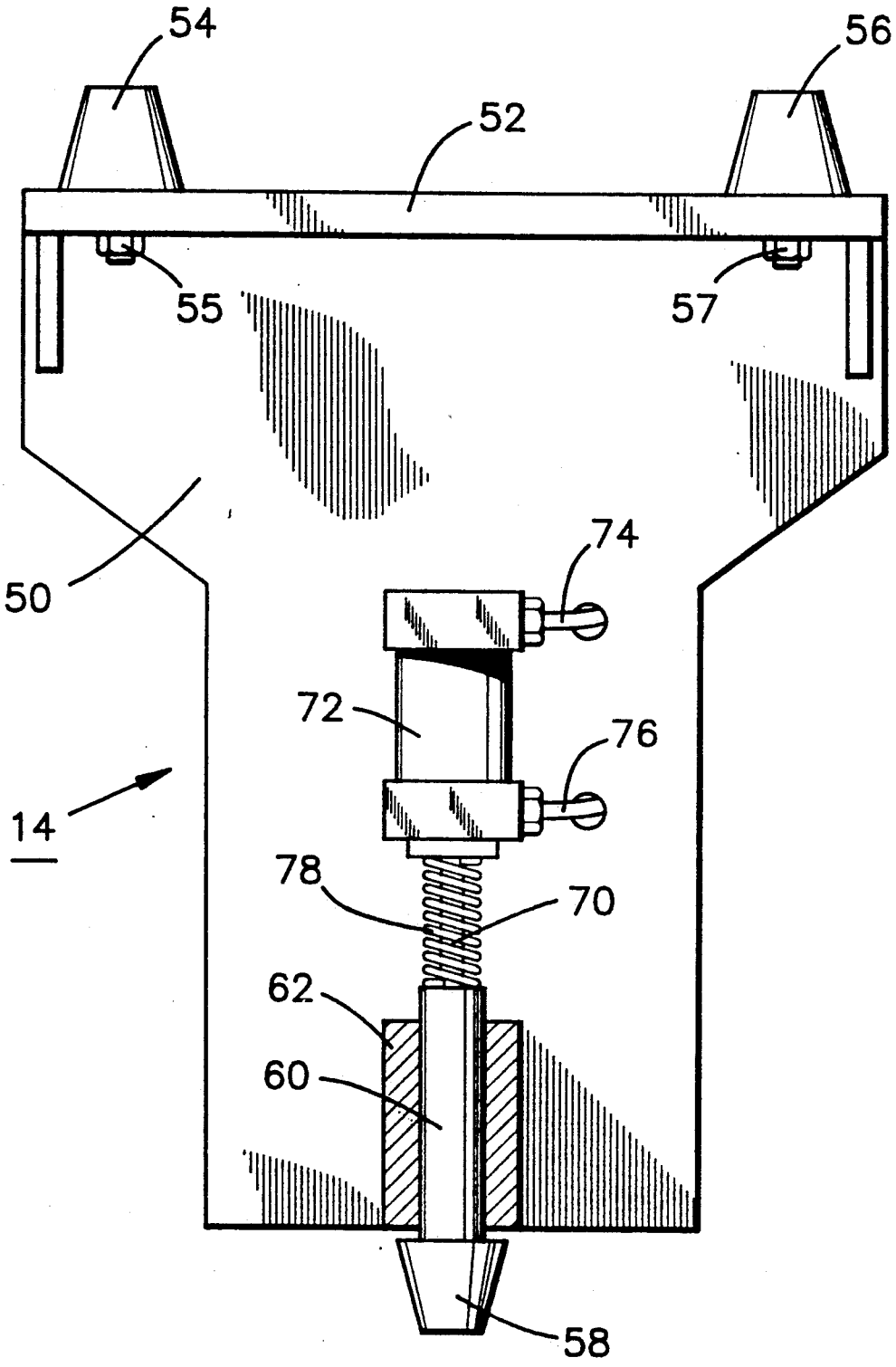
FIG. 2 is a side of elevational view, partially in cross-section, of a removable portion of the connector of FIG. 1.
Figure 3:
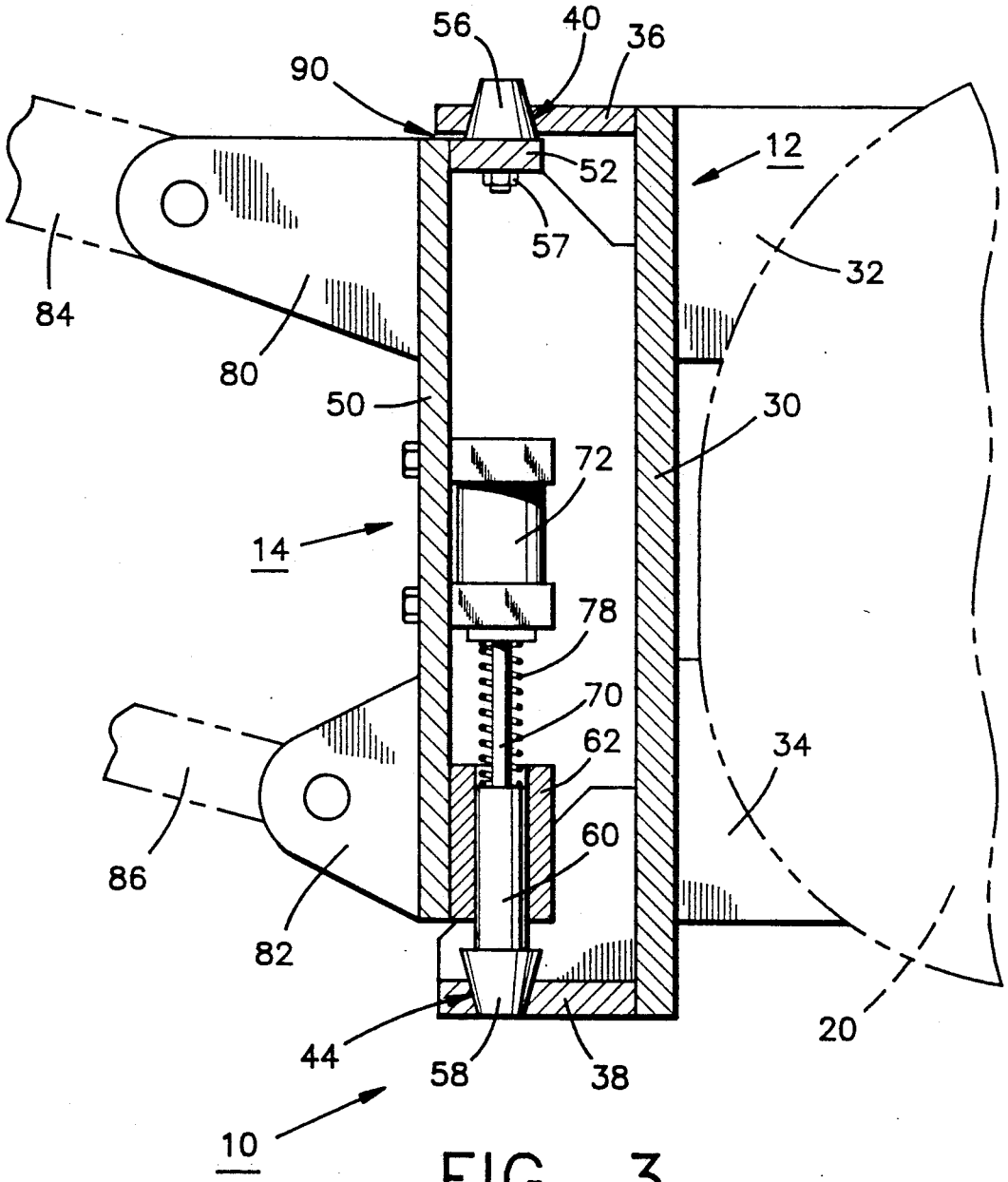
FIG. 3 is a side elevational view, partially in cross section, of the removable portion of FIG. 2.

Referring now to the Drawing, in which similar or identical elements are given consistant identifying numerals throughout the various figures thereof, and in which parenthetical references to figure numbers direct the reader to the view(s) in which the element(s) being described is (are) best seen, although the element(s) may be seen also in other views, FIGS. 1-3 illustrate one embodiment of the present invention, generally indicated by the reference numeral 10 (FIG. 3), having fixed and removable portions, generally indicated by the reference numerals 12 (FIG. 1) and 14 (FIG. 2), respectively.

FIG. 1 illustrates fixed portion 12 of connector 10 fixedly mounted to a construction implement, here, a shovel 20. Fixed portion 12 includes a flat base plate 30 having fixedly attached thereto attachment members 32 and 34 which are preferably welded to shovel 20, but may be attached to the shovel by other means such as with bolts. Extending orthogonally from the top and bottom of base plate 30 are flat support walls 36 and 38, respectively. Support wall 36 has defined therethrough two openings 40 and 42, symmetrically spaced apart near the ends of the support wall. Support wall 38 has defined therethrough one opening 44, generally centrally of the support wall.

Referring now to FIGS. 2 and 3, removable portion 14 of connector 10 includes a base plate 50 having a support wall 52 extending orthogonally from the upper end thereof. Fixedly mounted so as to extend orthogonally upwardly from the upper surface of support wall 52 are two frustoconical engagement cones 54 and 56, symmetrically spaced apart near the ends of the support wall, and held in place by means of nuts 55 and 57, respectively. Movably mounted so as to extend downwardly from the center of the bottom of base plate 50 is a frustoconical engagement cone 58. Engagement cone 58 is formed as an extension of a cylindrical support shaft 60 which is closely journaled in a housing 62, fixedly mounted to base plate 50, for axial back-and-forth movement of the support shaft within the housing. A piston 70 fixedly attached to support shaft 60 and extending into a hydraulic cylinder 72, fixedly attached to base plate 50, provides the axial force to move support shaft 60 by means of hydraulic pressure applied to the cylinder through lines 74 and 76. A spring 78 compressed between support shaft 60 and hydraulic cylinder 72 urges engagement cone away from the hydraulic cylinder and, therefore, away from engagement cones 54 and 56.

FIG. 3 illustrates fixed and removable portions 12 and 14, respectively, in joined relationship. It can be seen that, extending outwardly from the back of base plate 50 of removable member 14 and fixedly attached thereto are two flanges 80 and 82 which are rotatably attached to boom members 84 and 86 which may, for example, be associated with a back hoe (not shown). In the joined relationship shown, engagement cone 56 is in tight fitting engagement with hole 40 in support wall 36 on base plate 30 of fixed portion 12 of connector 10 and engagement cone 58 is in tight fitting engagement with hole 44 in support wall 38 on base 30 of fixed portion 12 of the connector. It will be understood that, in the joined relationship shown on FIG. 3, engagement cone 54 (FIG. 2) would also be in tight fitting engagement with hole 42 (FIG. 1) in support wall 36 on base plate 30 of fixed portion 12.

Fixed and removable portions 12 and 14, respectively, of connector 10 have been brought into the joined relationship shown on FIG. 3 by means of first operating hydraulic cylinder 72 so as retract engagement cone 58 into housing 62. Then, removable portion 14 is inserted into fixed portion 12 so as to insert engagement cones 54 and 56 (FIG. 2) into holes 40 and 42. Alignment need not be exact during this process, since engagement cones 54 and 56 will help guide fixed and removable portions 12 and 14 into alignment once the ends of the engagement cones come into contact with sides of holes 40 and 42. Finally, hydraulic cylinder 72 is operated so as to insert engagement cone 58 into hole 44. Spring 78 ensures the engagement cone 58 will remain in hole 44 even if hydraulic pressure is reduced or lost. Again, the tapers of engagement cone 58 and hole 44 assist in aligning the fixed and removable portions.

The self-adjusting features of connector 10 will now be described. It is readily apparent from inspection of FIG. 3 that any wear of the wall of hole 44 in support wall 38 and/or engagement cone 58 will be simple compensation for by slight additional movement of the engagement cone into the hole. Likewise, any wear of the walls of holes 40 and 42 in support wall 36 and/or engagement cones 54 and 56 will be compensated for by slight additional insertion of the engagement cones into the holes. Space 90 defined between support wall 36 of fixed portion 12 and support wall 52 of removable portion 14 permits the latter additional insertion movement.

Figure 4:
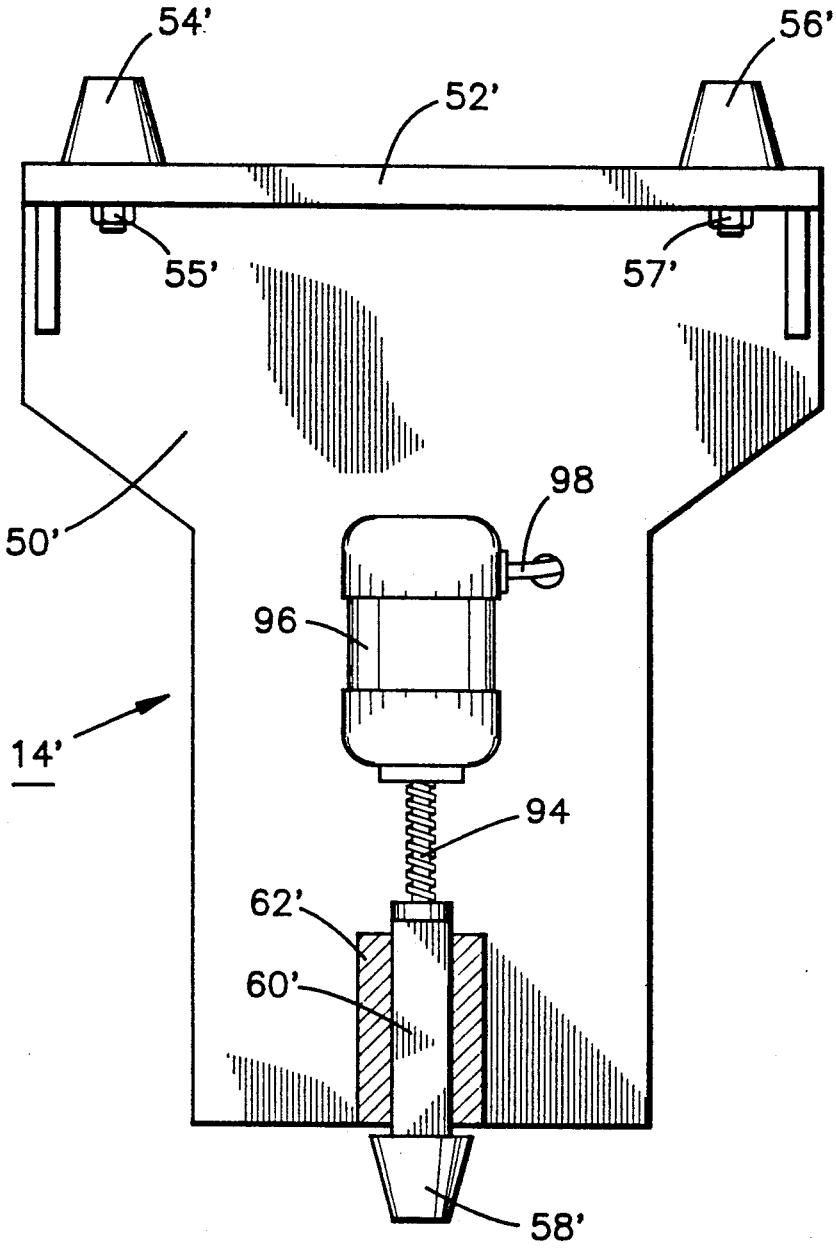
FIG. 4 is a side elevational view, partially in cross-section, of the removable portion of the connector according to an alternative embodiment.

FIG. 4 illustrates an alternative embodiment of the removable portion of the present invention, generally indicated by the reference numeral 14'. Elements common to removable portion 14 are given primed reference numerals. Here, engagement cone 58' is moved axially by means of a lead screw 94 rotated by an electric motor 96 which receives power through cable 98. Lead screw 94 may also be driven by a rotary hydraulic motor. It will be understood that support shaft 60' will have a square or rectangular cross-section to prevent its rotating within housing 62' as lead screw 94 is rotated.

Figure 5:
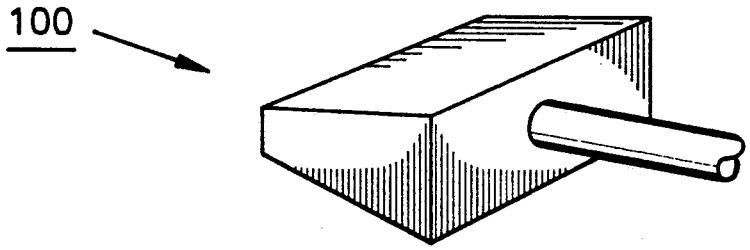
FIG. 5 is a perspective view of an alternative embodiment of a detail of the present invention.

FIG. 5 illustrates alternative engagement means, generally indicated by the reference numeral 100, which can be employed as part of the present invention. While the engagement means described so far have been frustoconical in shape, engagement means 100 has a truncated, tapered wedge shape.

It will be understood that engagement cones 54 and 56 may alternatively be mounted on removably portion 14 with corresponding holes 40 and 42 provided on fixed portion 12.

The structural elements of connector 10 can be economically and simply constructed from welded steel plate of suitable thickness for the particular application. Some or all of the structural elements may be also be molded by conventional technique. Hydraulic controls for operation of hydraulic cylinder 72 may be any suitable ones known in the art. Connector 10 is simple and has only one moving structure.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A connector for attachment of a construction implement to a boom on a piece of construction equipment, comprising:

(a) a fixed portion adapted for attachment to said implement;

(b) a removable portion adapted for attachment to said boom and joinable with said fixed portion;

(c) fixed engagement means disposed on one of said fixed and removable portions for insertion in an opening defined in the other one of said fixed and removable portions when said fixed and removable portions are engaged;

(d) movable engagement means disposed on one of said fixed and removable portions for insertion in an opening defined in the other one of said fixed and removable portions when said fixed and removable portions are engaged.

2. A connector, as defined in claim 1, wherein said fixed portion comprises:

(a) a base member adapted for attachment to said implement;

(b) a first support wall fixedly attached to and extending orthogonally from said base member, at least one of said openings being formed through said first support wall; and (c) a second support wall fixedly attached to and extending orthogonally from said base member, parallel to and spaced apart from said first support wall, at least one of said openings being formed through said first support wall.

3. A connector, as defined in claim 1, wherein said fixed portion comprises:

(a) a base member adapted for attachment to said boom;

(b) a support wall fixedly attached to and extending orthogonally from said base member, said fixed engagement means being fixedly attached to said support wall; and (c) said movable engagement means being movably attached to said base member and spaced apart from said support wall.

4. A connector, as defined in claim 1, wherein said engagement means and said openings have complementary tapered shapes such that said engagement means and said openings tightly fit together when said fixed and movable portions are joined.

* * * * *